United States Patent [19]

Baumgartner et al.

[11] 3,940,063

[45] Feb. 24, 1976

[54] APPARATUS FOR SPRAY-COATING PRODUCT ONTO AN ARTICLE

[75] Inventors: Jon B. Baumgartner, Lisle; James J. Moran, Orland Park, both of Ill.

[73] Assignee: Nalco Chemical Company, Oak Brook, Ill.

[22] Filed: May 30, 1975

[21] Appl. No.: 582,145

[52] U.S. Cl. ..... 239/70; 239/112; 239/229; 239/347; 141/18

[51] Int. Cl.[2] ..... B05B 15/02; B65B 1/04

[58] Field of Search ..... 239/227, 104, 229, 70, 239/112, 318, 340, 346, 347, 348, 372; 141/21, 18; 425/225; 164/149, 158

[56] References Cited

UNITED STATES PATENTS

| | | | |
|---|---|---|---|
| 1,668,080 | 5/1928 | Mack | 239/112 X |
| 2,381,649 | 8/1945 | Dalton | 141/18 X |
| 2,471,049 | 5/1949 | Thornton et al. | 239/104 X |
| 2,630,347 | 3/1953 | Petery et al. | 239/70 X |
| 3,384,132 | 5/1968 | Lisciani | 141/18 |
| 3,385,522 | 5/1968 | Kock | 239/104 |
| 3,572,366 | 3/1971 | Wiggins | 239/112 X |
| 3,618,862 | 11/1971 | Phelps | 239/347 X |

*Primary Examiner*—Robert S. Ward, Jr.
*Attorney, Agent, or Firm*—Lockwood, Dewey, Zickert & Alex

[57] ABSTRACT

Apparatus for coating steel mill molds and stools including a sample bomb or container and means for filling the bomb with a precise amount of product to thereafter be discharged through a spray nozzle. The apparatus further includes means for automatically rinsing same after each application.

10 Claims, 2 Drawing Figures

APPARATUS FOR SPRAY-COATING PRODUCT ONTO AN ARTICLE

Figure 2:
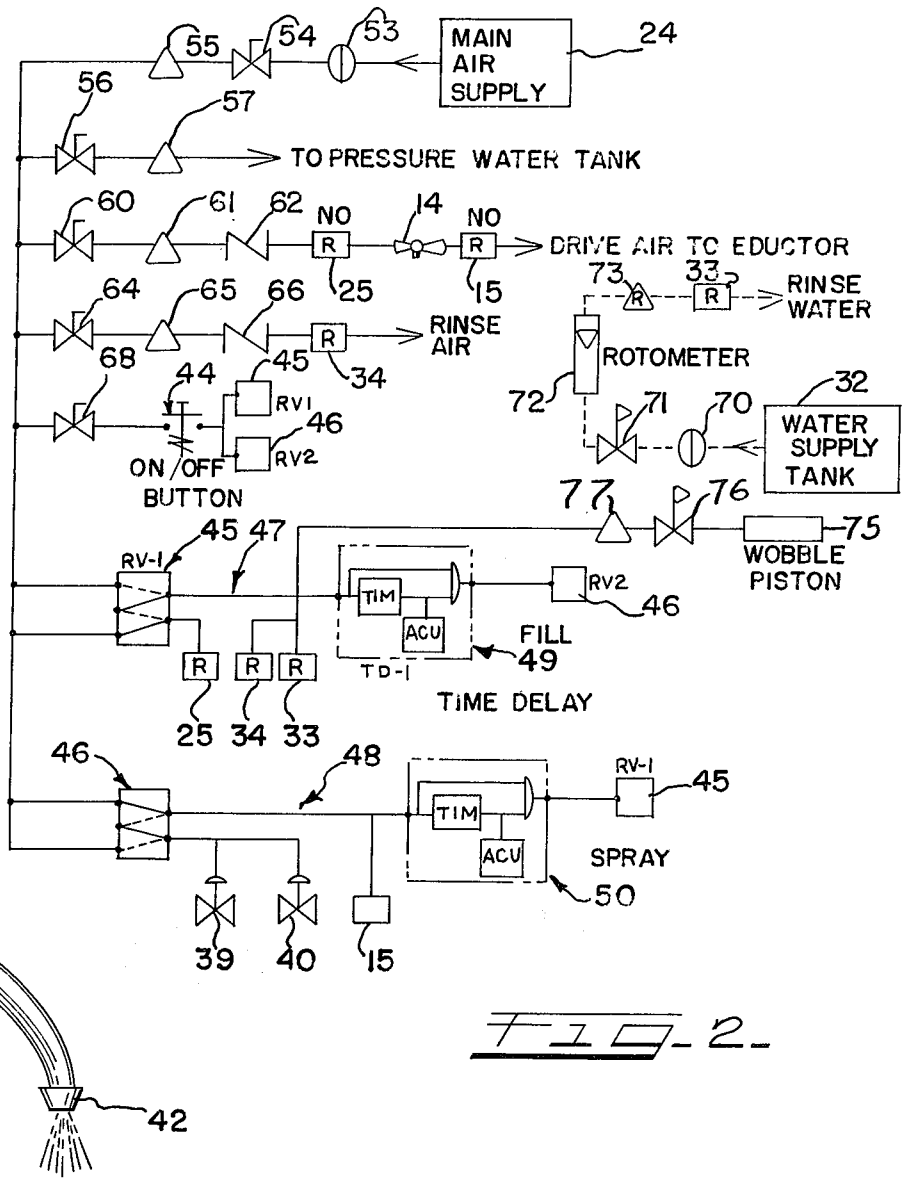

The present invention relates in general to an apparatus for applying a coating of product to an article, and more particularly to an apparatus for applying a given amount of product during one application to an article, and still more particularly to an apparatus capable of handling an abrasive, unstable product and having the capability of being completely rinsed after each spray application.

The present invention is particularly useful for coating steel mill molds and stools with a highly abrasive, unstable liquid product where the coating apparatus must be rinsed after each coating application. Moreover, the apparatus is constructed to discharge a given amount of solution during each spray application. However, it should be appreciated the apparatus is capable of spraying products other than a mold or stool coating such as dust-control additives or slug feeding of precise quantities of biocides.

Exemplary of the type of coating useful for steel mill molds and stools is a refractory slurry, such as a non-suspended type where refractory grain is mixed with a liquid binder. The refractory grain may be in the form of fused silica or quartz silica, while the liquid binder may be in the form of a colloidal suspension of silica in water. The refractory grain and liquid binder are usually mixed equally by weight. A satisfactory refractory grain in the form of powdered fused silica is one sold under the trademark "NALCOTE 870P", by Nalco Chemical Company of Chicago, Ill. A satisfactory liquid binder in the form of a colloidal suspension of silica and water is one sold under the trademark "NALCOTE 880L", also by Nalco Chemical Company of Chicago, Ill. Such a refractory slurry is highly abrasive and unstable since the refractory grain tends to quickly settle. It is therefore preferable to use equipment for handling such a slurry that can be easily cleaned to thereby prevent malfunctioning of the equipment.

The apparatus of the present invention includes a sample bomb or container having a fill and empty port at its bottom end and an air port at its upper end. The fill and empty port is connected through a pneumatically operated valve to a product, such as source of coating material and also through a pneumatically operated valve to a spray nozzle. The air port is connected through a float check valve to a venturi eductor. An eductor control valve operably conditions the venturi eductor to create a negative pressure within the sample bomb to fill same or a positive pressure for emptying same. Air and water rinse lines are connected through the eductor, the float check valve, the sample bomb and the spray nozzle line for rinsing the apparatus after a spray application. Other pneumatic control valves are provided for operation of the apparatus through an automatic fill and empty cycle.

It is therefore an object of the present invention to provide a new and improved apparatus for spray coating a solution onto an article, and particularly for spray-coating a highly abrasive, unstable fluid in a measured quantity onto steel mill molds and stools.

A further object of the present invention is in the provision of providing a spray-coating apparatus having rinse capabilities and instrumentation controls for causing it to automatically apply a measured amount of solution to an article and to be self-cleaning during a full operation cycle.

Still a further object of the present invention resides in the provision of a spray-coating apparatus which can operate as a positive displacement pump and which is completely pneumatically powered.

Figure 1:
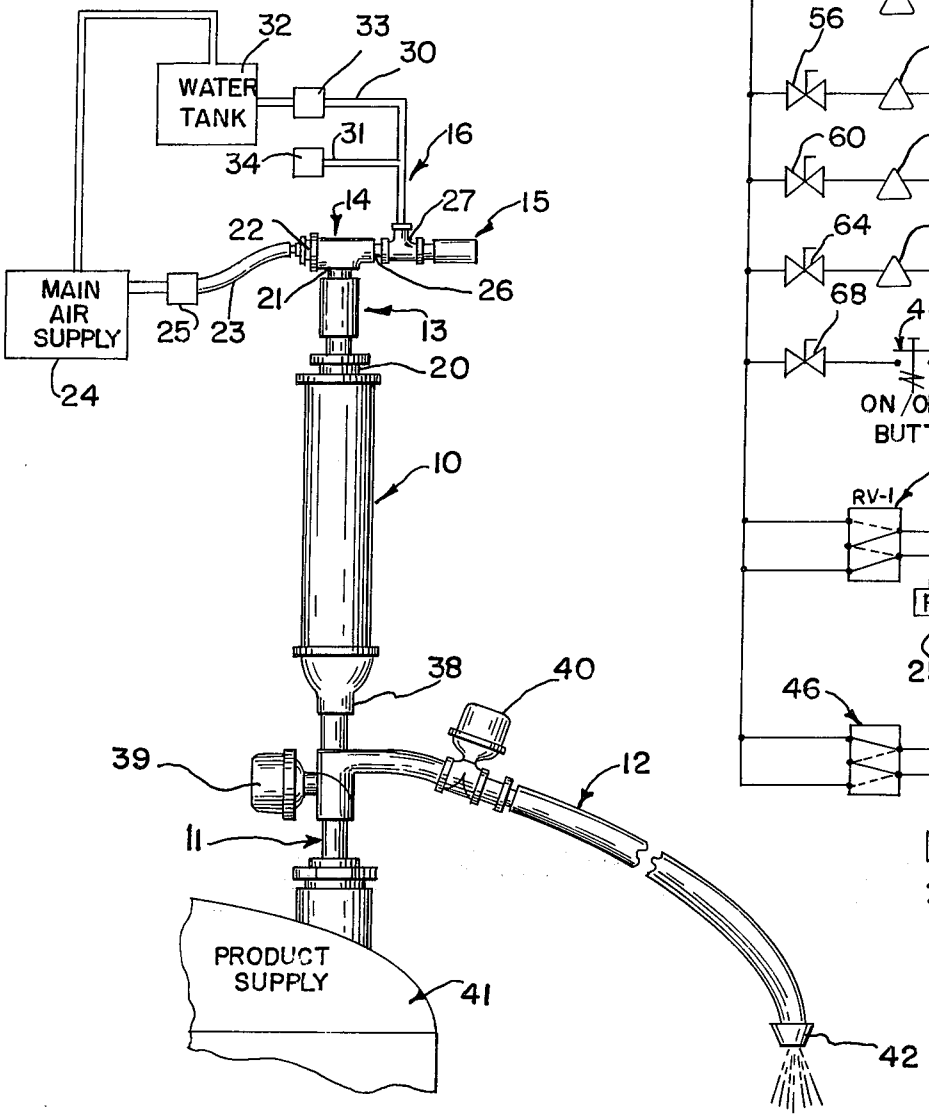

Other objects, features and advantages of the invention will be apparent from the following detailed disclosure, taken in conjunction with the accompanying sheet of drawings, wherein like reference numerals refer to like parts, in which:

FIG. 1 is a somewhat diagrammatic view of the apparatus for spray-coating according to the present invention with some parts broken away for purposes of simplicity; and FIG. 2 is a schematic view of the pneumatic circuit for the apparatus of the invention.

Referring now to the drawings, and particularly to FIG. 1, the apparatus for spray-coating articles according to the invention includes generally a sample bomb or container 10, a fill line 11 through which a supply of product is drawn into the sample bomb 10, a spray line 12 through which the product in the sample bomb is discharged for coating an article, a float check valve 13 for setting the product level in the sample bomb 10 at a predetermined level, a venturi eductor 14, an eductor control valve 15 for controlling the fill and empty cycles of the sample bomb 10, and a rinse line 16 for rinsing the sample bomb 10 and spray line 12 following a coating application.

While the sample bomb 10 illustrated is cylindrical in shape, it should be appreciated it could be of any suitable shape and the size of the bomb may be chosen to provide the desired measured amount of solution for application through the spray line 12 onto an article. Further, the float check valve 13 may be adjusted to regulate the desired level of solution in the sample bomb when it is filled to regulate the measured amount of product to be sprayed.

The float check valve 13 is connected to the upper end of the sample bomb 10 at an air port 20 and to a pressure port 21 of the venturi eductor 14. An inlet port 22 of the venturi eductor 14 is connected to a drive air line 23 which in turn is connected to a main air supply 24 through a normally open pneumatic valve 25. An outlet port 26 of the eductor is connected to a T-fitting 27 that is in turn connected to the rinse line 16 and the eductor control valve 15.

The rinse line 16 feeds a mixture of air and water to the apparatus when it is in rest position and is connected to a rinse water line 30 and a rinse air line 31. Water is supplied to the water line 30 from a water supply tank 32 and is controlled by a pneumatic normally open valve 33. The rinse air line 31 is connected to the main air supply 24 through a normally open pneumatic valve 34.

At the lower end of the sample bomb 10, a fill and empty port 38 connects to the fill line 11 having therein a normally closed pneumatic valve 39. A normally open pneumatic valve 40 is mounted in the spray line 12. The fill line 11 is connected to a product supply tank 41, while the spray line 12 is connected to a spray nozzle 42.

As illustrated in the schematic circuit diagram of FIG. 2, operation of valves 25, 34 and 33 is controlled by a pneumatic control valve 45, while operation of valves 39, 40 and 15 is controlled by a pneumatic control valve 46. A pneumatic push-button switch 44 functions to actuate control valves 45 and 46 to cause shifting of their connections in respective fill and spray circuits 47 and 48 to shift from the solid line connections shown in FIG. 2 to the dotted line connections. A fill timer 49 and a spray timer 50, in respectively the fill and spray circuits 47 and 48, control the "on" time of the control valves 45 and 46.

The main air supply 24 connects to a manifold air line 52 through a filter 53, a ball valve 54 providing on and off control, and a regulator and gage assembly 55. From the manifold line 52, air is supplied to pressurize the water tank through an on-off ball valve 56 and a regulator and gage assembly 57. Drive air to the eductor 14 comes from the manifold line 52 through an on-off ball valve 60, a regulator and gage assembly 61, a check valve 62, and the pneumatic valve 25. Rinse air is supplied to the rinse air line 31 through an on-off ball valve 64, a regulator and gage assembly 65, a check valve 66 and the pneumatic valve 34. Air is supplied to the pneumatic control valves 45 and 46 from the manifold line through an on-off ball valve 68 and the push-button switch 44. Rinse water in the rinse water line 30 is supplied from the water supply tank 32 through a filter 70, a needle valve 71, a rotometer 72, a water flow regulator 73, and the pneumatic valve 33.

During operation of the apparatus, it will go through three distinct cycles, a rinse or rest cycle, a fill cycle where the bomb is being filled with product, and a spray cycle where the bomb is being emptied of product. During the rinse cycle, air and water are forced through the bomb and the spray line.

When the system is at rest or in the rest or rinse cycle, the pneumatic valves 15 and 25 are pressurized and therefore closed. Since normally closed valve 39 is not pressurized, it is also closed. Normally open valves 33 and 34 are open since they are not pressurized. Similarly, normally open valve 40 is open since it is not pressurized. Accordingly, a mixture of water and air passed down through the eductor, the sample bomb 10 and out through the spray line 12. This prevents the residual product in the bomb and spray line from drying and plugging the system when it is not in use, and therefore guards against malfunction.

When the operator pushes the on-off switch 44, the pneumatic control valves 45 and 46 are actuated to make the dotted line connections shown in FIG. 2. Control valve 45 therefore removes pressure from the pneumatic valve 25 so that it will open and allow drive air to be supplied to the eductor 14. Further, control valve 45 causes pressurization of normally open valves 33 and 34 to close same and cut off the mixture of rinse water and air to the eductor. Further, the control valve 45 actuates the fill timer 49.

Control valve 46, when actuated, pressurizes valves 39 and 40 to open valve 39 and permit the communication of the product supply tank 41 with the fill and empty port 38 of the sample bomb 10 and closes spray valve 40 in the spray line 12 to prevent discharge of product through the spray line. Additionally, control valve 46 causes depressurizing of eductor control valve 15 so that the drive air will go through the eductor from the inlet port 22 through the outlet port 26, the eductor control valve 15 to atmosphere and cause a vacuum or negative pressure situation in the sample bomb 10 to draw product from the product supply tank into the sample bomb. When a predetermined level of product is reached in the sample bomb, it will actuate the float check valve, thereby cutting off the supply of negative pressure from the eductor 14 and ending the fill cycle. When the fill timer 49 times out, it will actuate the control valve 46 to bring the connections back to the solid line positions shown in FIG. 2 for closing the product supply valve 39, opening the spray line valve 40, and closing the eductor control valve 15. Additionally, the spray timer 50 is actuated. By closing the eductor control valve 15, the drive air is diverted directly into the sample bomb 10 pressurizing same with a positive pressure to cause driving of the product through the bomb and the spray line and emptying of the bomb. When the spray timer times out, it will actuate control valve 45 to return it to its rest position with the connections shown in solid lines in FIG. 2 to close the drive air valve 25 and open the rinse water valve 33 and the rinse air valves 34 to again place the sytem into its rinse or rest cycle for causing a mixture of air and water to pass through the bomb and spray line. Thereafter, the sytem remains at rest until the push-button switch 44 is again pushed to cause a fill and spray cycle.

An air driver wobble piston unit 75 is provided to drive the nozzle 42 through a wobble pattern and enable uniform spraying over a given area. A needle valve 76 and a regulator 77 control the speed of the unit which operates during the spray cycle.

From the foregoing, it can be appreciated the apparatus of the invention is completely pneumatic and operates automatically through a fill and spray cycle to cause discharge of a predetermined amount of product. It can be appreciated the fill rate of the bomb can be controlled by changing the air pressure to the eductor, while the fill time of the bomb is controlled by the pneumatic timer which when timed out automatically commences the application or spray cycle. The length of the spray cycle is controlled by the timer and the rate of spray is controlled by the drive air pressure. Further, it can be appreciated the apparatus is self-cleaning to prevent plugging when the system is not in use.

It will be understood that modifications and variations may be effected without departing from the scope of the novel concepts of the present invention, but it is understood that this application is to be limited only by the scope of the appended claims.

The invention is hereby claimed as follows:

1. Apparatus for spray-coating a product onto an article comprising, a container adapted to be filled and emptied with product to effect spraying a measured amount of product onto an article, a fill and empty port at the bottom of the container, a supply of product, a spray line having a spray nozzle, first means for selectively interconnecting said supply and said fill and empty port, second means for selectively interconnecting the spray line and said fill and empty port, an air port at the upper end of the container, product level control means adjacent the air port responding to a predetermined product level for closing the air port when the product level in the container reaches said predetermined level, and a venturi eductor connected to the product level control means having an air inlet connected to an air supply and an outlet connected to a control valve for selectively opening and closing the outlet to atmosphere and creating negative and positive pressure conditions in the container, whereby said container is filled during the negative pressure condition and emptied during the positive pressure condition.

2. Apparatus as defined in claim 1, which further includes means for rinsing the container and spray line with a mixture of air and water when the apparatus is not being used.

3. Apparatus as defined in claim 2, wherein said rinsing means includes a rinse line connected to the outlet of the eductor, a water line connected to the rinse line and to a source of water, an air line connected to the rinse line and to a supply of air, and valves in the water and air lines for controlling the rinse for the container and spray line.

4. Apparatus as defined in claim 1, wherein said product level control means includes a float control check valve.

5. Apparatus for spray-coating a measured amount of liquid product onto an article comrising, a container adapted to be filled and emptied with a measured amount of product, a fill and empty port at the bottom of the container, a supply of product, a spray line having a spray nozzle, a first pneumatic valve for opening and closing communication between said product supply and said fill and empty port, a second pneumatic valve for opening and closing communication between said spray line and said fill and empty port, an air port at the top of the container, a float check valve at the air port responding to a predetermined product level in the container to close the air port when the product level reaches said predetermined level, a venturi eductor having a pressure port connected to the air port, an inlet port connected to an air supply, and an outlet port connected to a pneumatic eductor control valve, a third pneumatic valve between the air supply and said eductor inlet port selectively opening and closing communication between the air supply and eductor inlet port, said eductor control valve selectively opening and closing said outlet to atmosphere to cause respectively negative and positive pressure conditions at said pressure port and within the container, whereby said container may be filled during a negative pressure condition and emptied during a positive pressure condition, and means for rinsing the container and spray line with a mixture of air and water when the apparatus is not being used.

6. Apparatus as defined in claim 5, wherein said rinsing means includes a rinse line connected to the outlet of the eductor, a water line connected to the rinse line and to a source of water, an air line connected to the rinse line and said air supply, a fourth pneumatic valve for opening and closing communication between said water source and said water line, and a fifth pneumatic valve for opening and closing communication between said air supply and said air line.

7. Apparatus as defined in claim 6, which further includes a pneumatic control circuit for said pneumatic valves to automatically on signal cause cyclic operation of the valves to fill the container with a measured amount of product, empty the container by spraying the product through the nozzle, and rinse the container and spray line.

8. Apparatus as defined in claim 7, wherein said control circuit includes means timing the fill and spray cycles.

9. Apparatus as defined in claim 8, wherein the product is an unstable abrasive liquid, and said rinse cycle causes cleaning of the apparatus to prevent drying and plugging.

10. Apparatus as defined in claim 9, wherein said control circuit includes a push-button switch for commencing fill and spray cycles, and first and second pneumatic control valves for controlling operation of said first, second, third, fourth, fifth and eductor control valves.

* * * * *